US007077370B2

(12) United States Patent
Lin et al.

(10) Patent No.: US 7,077,370 B2
(45) Date of Patent: Jul. 18, 2006

(54) HAIR DRYER STAND FOR A HANDHELD HAIR DRYER

(75) Inventors: Eric Lin, Taipei (TW); Cheng-Yung Tung, Taipei (TW); Ching-Chang Chuang, Taipei (TW)

(73) Assignee: Winner Double-H Co., Ltd., Taipei (TW)

( * ) Notice: Subject to any disclaimer, the term of this patent is extended or adjusted under 35 U.S.C. 154(b) by 280 days.

(21) Appl. No.: 10/819,988

(22) Filed: Apr. 8, 2004

(65) Prior Publication Data

US 2005/0224666 A1 Oct. 13, 2005

(51) Int. Cl.
*F16M 11/00* (2006.01)
*A45D 20/12* (2006.01)

(52) U.S. Cl. ..... 248/176.2; 248/309.1; 248/185.1; 34/90; 34/97

(58) Field of Classification Search ..... 248/176.2, 248/176.1, 309.1, 311.2, 314, 316.8, 185.1; 16/337; 34/90, 97
See application file for complete search history.

(56) References Cited

U.S. PATENT DOCUMENTS 2,421,643 A * 6/1947 Ostli ..... 362/106
2,500,048 A * 3/1950 Stoiber ..... 248/184.1
2,778,931 A * 1/1957 Cruz ..... 362/388
3,008,259 A * 11/1961 Zornes ..... 43/43.12
3,322,388 A * 5/1967 Budreck ..... 248/478
3,501,119 A * 3/1970 Rich, Jr. ..... 248/219.3
4,341,452 A * 7/1982 Korling ..... 396/428
4,671,476 A * 6/1987 Yim ..... 248/117.2
4,874,142 A * 10/1989 Gelatt ..... 248/185.1
5,069,407 A * 12/1991 Williams ..... 248/222.11
5,172,880 A * 12/1992 McDougall ..... 248/185.1
5,392,350 A * 2/1995 Swanson ..... 379/446
5,590,475 A * 1/1997 Andis ..... 34/97
5,636,815 A * 6/1997 Wilson ..... 248/125.9
D391,266 S * 2/1998 Richter ..... D14/253
5,937,537 A * 8/1999 Miller ..... 34/97
6,018,847 A * 2/2000 Lu ..... 16/337
6,390,424 B1 * 5/2002 Kidushim et al. ..... 248/122.1
6,520,467 B1 * 2/2003 Thomas et al. ..... 248/309.3
2002/0107043 A1 * 8/2002 Adamson et al. ..... 455/550

* cited by examiner

*Primary Examiner*—Anita M. King
(74) *Attorney, Agent, or Firm*—Lowe Hauptman & Berner, LLP

(57) ABSTRACT

A hair dryer stand for a handheld hair dryer includes a base and a holder pivotally mounted on the base. The base has a top face, two parallel ears protruding from the top face and two fastening assemblies. The holder has two curved sides and a space. The curved sides are formed together to form the space between the curved sides so the holder is able to clamp a hair dryer. The curved sides also have pivot pins with threaded holes, which are mounted respectively in the ears on the base and held in place by the fastener assemblies. The angle of a hair dryer mounted in the holder can be adjusted relative to the base to accommodate a specific person so that the person is able to use the hair dryer without holding it.

12 Claims, 6 Drawing Sheets

HAIR DRYER STAND FOR A HANDHELD HAIR DRYER

BACKGROUND OF THE INVENTION

1. Field of the Invention

The present invention relates to a hair dryer stand, and more particularly to a hair dryer stand for a handheld hair dryer, which is able to hold a hair dryer when the hair dryer is being used.

2. Description of Related Art

Hair dryers are very common household appliances. Particularly, women who like to make themselves prettier consider hair dryers a necessity.

When a person uses a hair dryer, the person needs one hand to hold the hair dryer and another hand to hold a tool, such as a hairbrush, hair spray, etc.

Although the hair dryer is useful, the need to hold the hair dryer is a significant limitation. When a person needs both hands to style their hair or do other things like writing or holding another tool, the hair dryer can only be used intermittently, or the person needs an extra hand.

To overcome the shortcomings, the present invention provides a hair dryer stand to mitigate or obviate the aforementioned problems.

SUMMARY OF THE INVENTION

The primary objective of the present invention is to provide a hair dryer stand for a handheld hair dryer that will allow a person to use the hair dryer without holding the hair dryer.

Another objective of the present invention is to provide a holder that is pivotal relative to the base such that the angle of the hair dryer can be adjusted to different positions.

Other objects, advantages and novel features of the invention will become more apparent from the following detailed description when taken in conjunction with the accompanying drawing.

DETAILED DESCRIPTION OF PREFERRED EMBODIMENT

Figure 1:
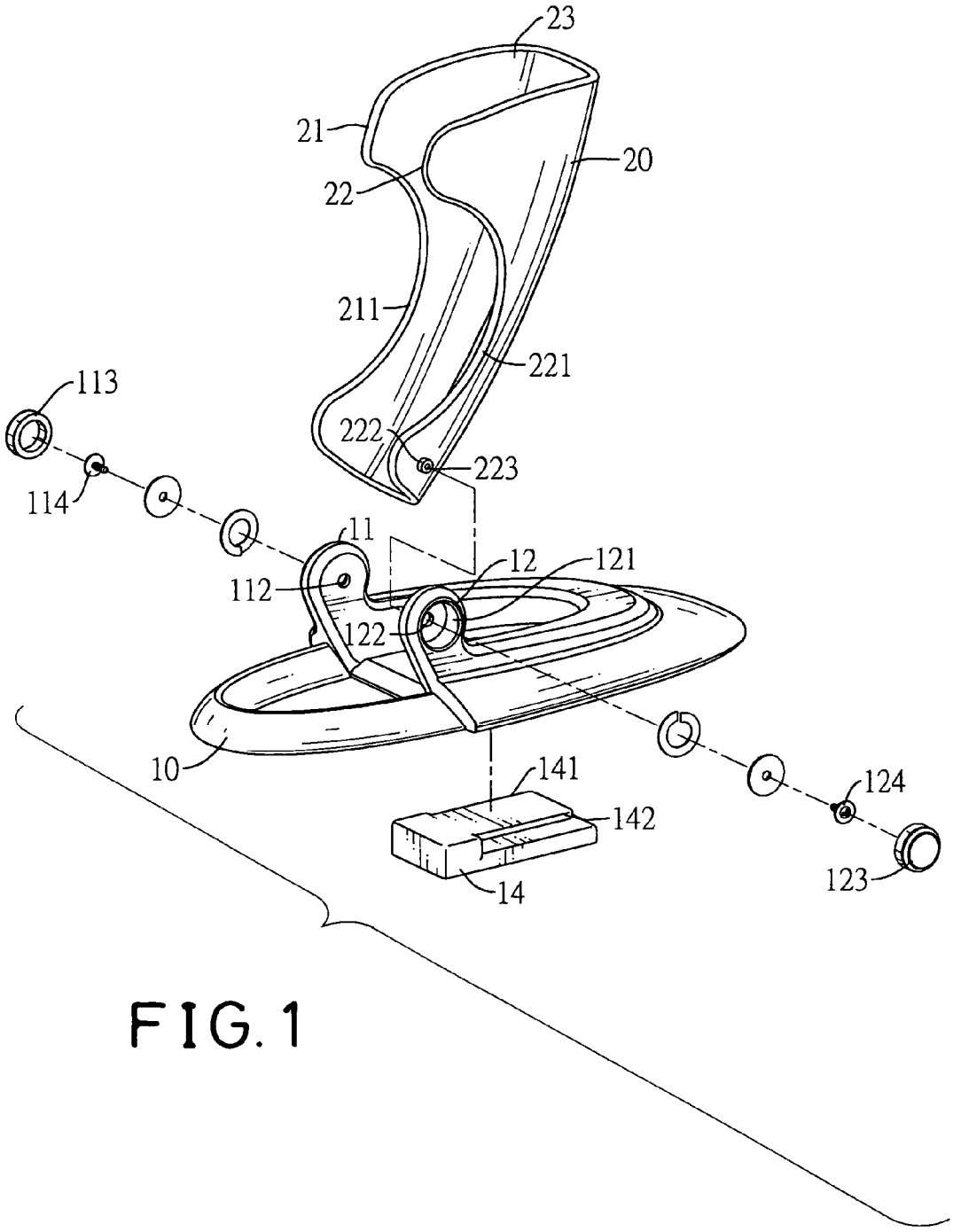
FIG. 1 is an exploded perspective view of the hair dryer stand in accordance with the present invention.
Figure 2:
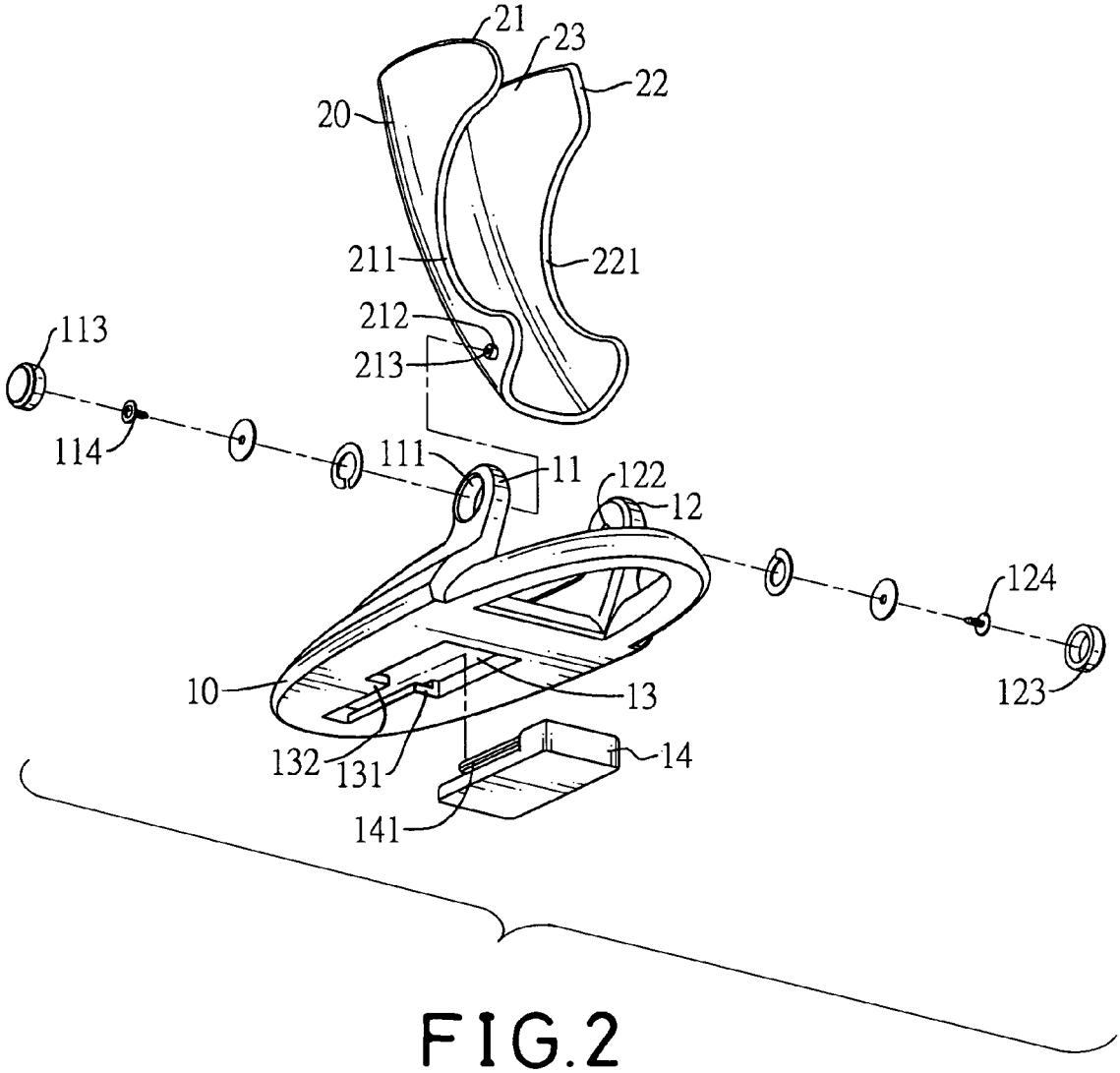
FIG. 2 is an exploded bottom perspective view of the hair dryer stand in FIG. 1.
Figure 3:
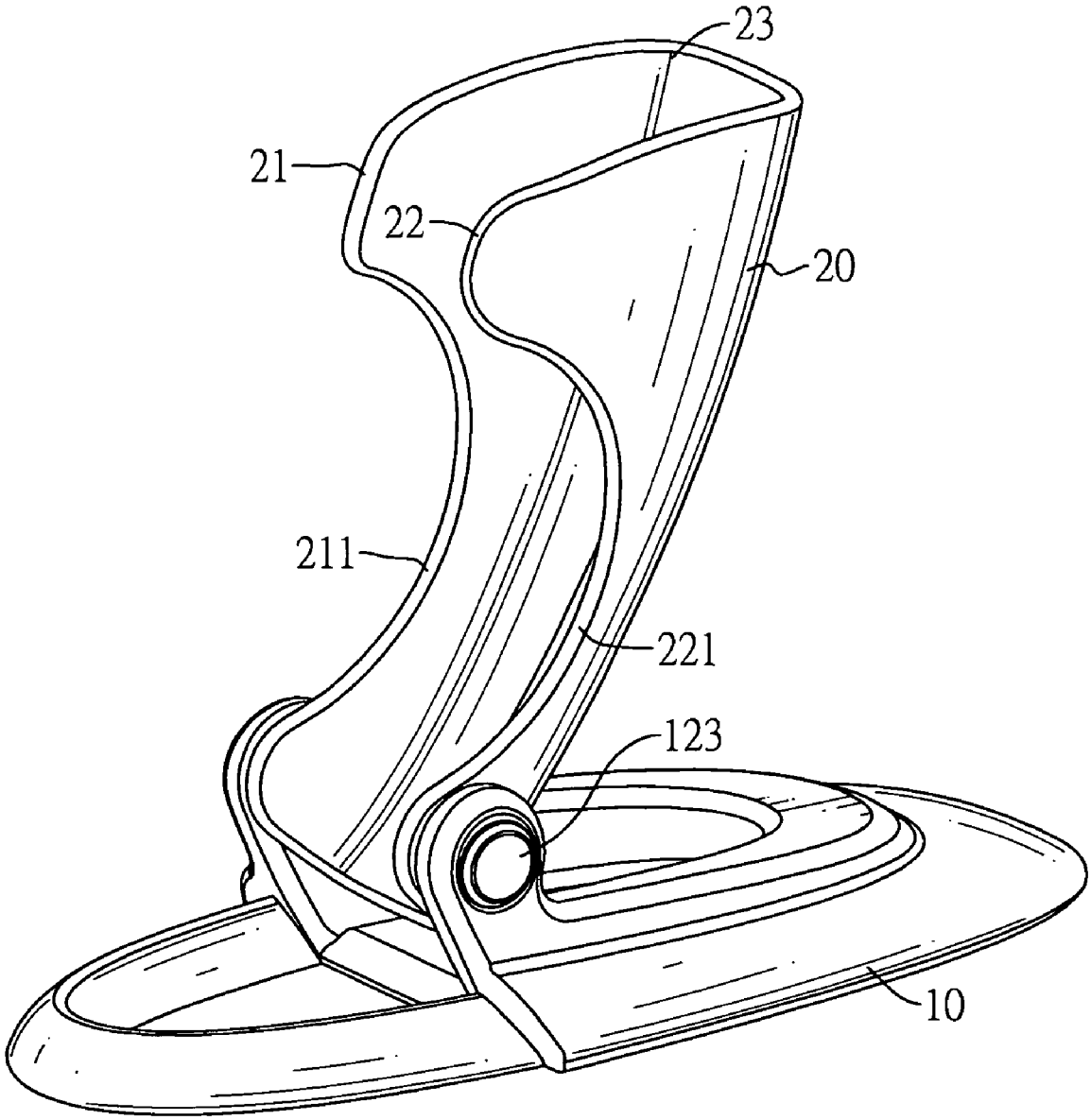
FIG. 3 is a perspective view of the hair dryer stand in FIG. 1.
Figure 4:
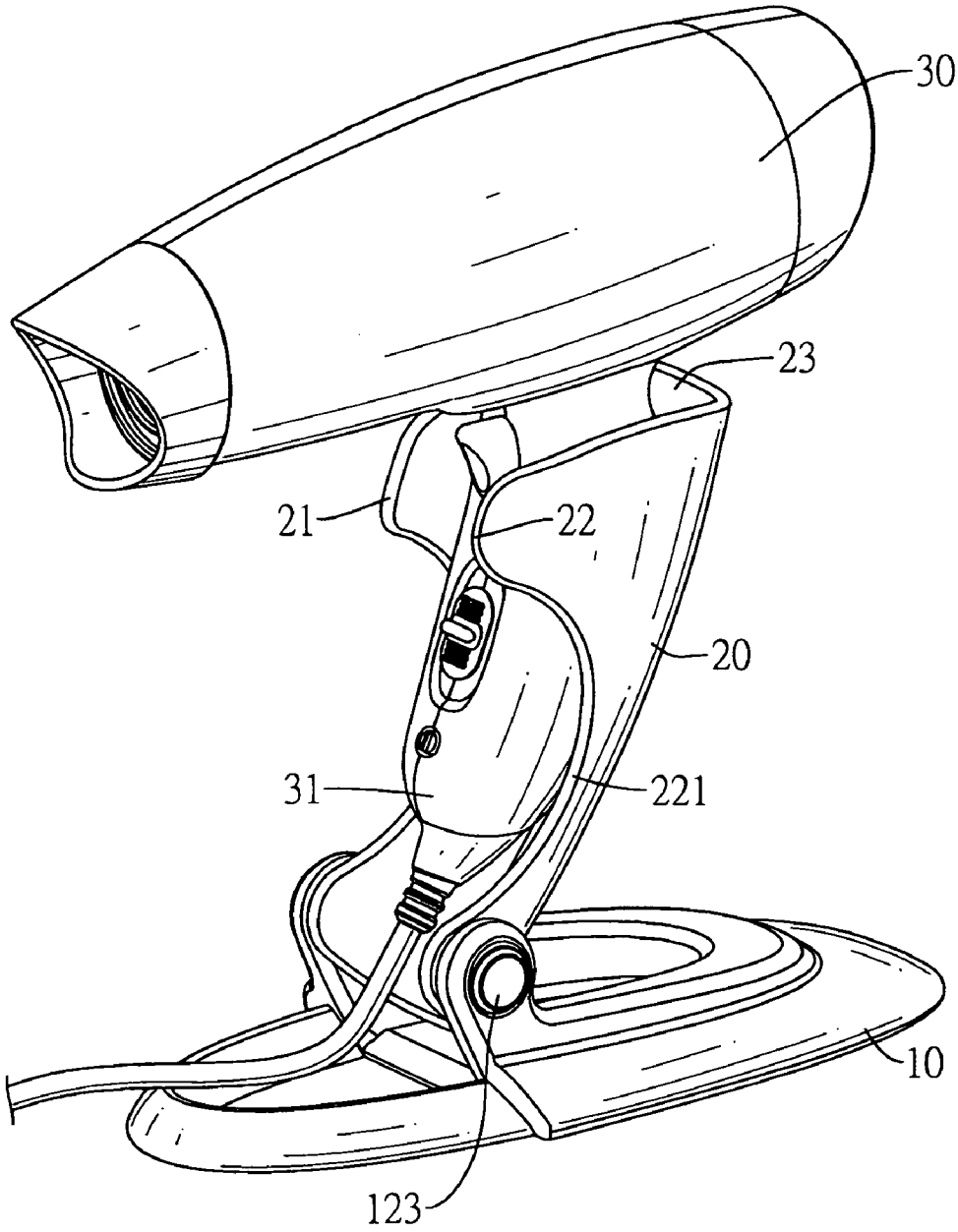
FIG. 4 is an operational perspective view of the hair dryer in FIG. 3 with a hair dryer.

With reference to FIGS. 1, 2, 3 and 4, a hair dryer stand for a handheld hair dryer with a handle comprises a base (10) and a holder (20).

The holder (20) is mounted pivotally on the base (10) and has two curved sides (21, 22) and a space (23). The curved sides (21, 22) are formed with each another and define the space (23) between the curved sides (21, 22). Each curved side (21, 22) has a mediate section (not numbered), a proximal end (not numbered), a distal end (not numbered), an outside surface (not numbered), an inside surface (not numbered), an optional cutout (211, 221) and a pivot pin (212, 222). The cutouts (211, 221) are defined respectively in the mediate sections of the curved sides (21, 22) to facilitate access to the hair dryer. The pivot pins (212, 222) are formed respectively on the outside surfaces of the curved side (21, 22) near the proximal end and are aligned with each other. Each pivot pin (212, 222) has an axial threaded hole (213, 223) defined longitudinally through the pivot pin (212, 222).

The base (10) has two sides (not numbered), a top face (not numbered), a bottom face (not numbered), a first ear (11), a second ear (12), an optional mounting recess (13) and an optional wall bracket (14).

The first and second ears (11, 12) are formed on and extend up from the top face of the base (10) respectively near the sides, are aligned with each other and respectively have inside surfaces (not numbered), outside surfaces (not numbered), recessed areas (111, 121), pivot holes (112, 122), fastener assemblies (not numbered) and optional caps (113, 123).

The recessed area (111, 121) are defined respectively in the outside surfaces of the first and second ears (11, 12), are aligned with each other and respectively have centers (not numbered) and bottoms (not numbered).

The pivot holes (112,122) are defined respectively through the centers of the recessed areas (111, 121).

The fastener assemblies pivotally connect the holder (20) to the ears (11, 12) and respectively comprise two washers (not numbered), two lock washers (not numbered) and two fasteners (not numbered). The washers and lock washers are sequentially mounted respectively in the recessed areas (111, 121) with the lock washers respectively in the bottoms of the recessed areas (111, 112). The fasteners may be bolts (114, 124) or screws (not shown), pass respectively through the washers, lock washers and pivot holes (112, 122) and screw respectively into the threaded holes (213, 223).

The caps (113,123) are mounted respectively in and cover the recessed areas (111,121) in the ears (11, 12).

The mounting recess (13) is defined in the bottom face of the base (10) and has a top end (not numbered), a bottom end (not numbered), two sides (not numbered) and at least one lip (not numbered). The at least one lip is located at the top end of the mounting recess (13) and may be a single lip (not numbered) or two lips (131,132). Where a single lip is implemented, the lip is located at the top end of the mounting recess (13). Where two lips (131, 132) are implemented, the two lips (131, 132) are located respectively on opposite sides of the mounting recess (13) at the top end.

The wall bracket (14) is connected to a vertical surface and has a top end (not numbered), two sides (not numbered), a front surface (not numbered) and a rear surface (not numbered) and at least one tongue (not numbered). When the mounting recess (13) has a single lip at the top end, the wall bracket (14) has a single tongue (not numbered) parallel to the front surface and protruding toward the top end, which selectively engages the lip in the mounting recess (13) corresponding to the at least one lip in the mounting recess (13). When the mounting recess (13) has two lips (131, 132) respectively on the sides at the top end, the wall bracket (14) has two tongues (141, 142) parallel to the front surface and protruding respectively toward the sides, which selectively engage the lips (131, 132) in the mounting recess (13).

Figure 5:
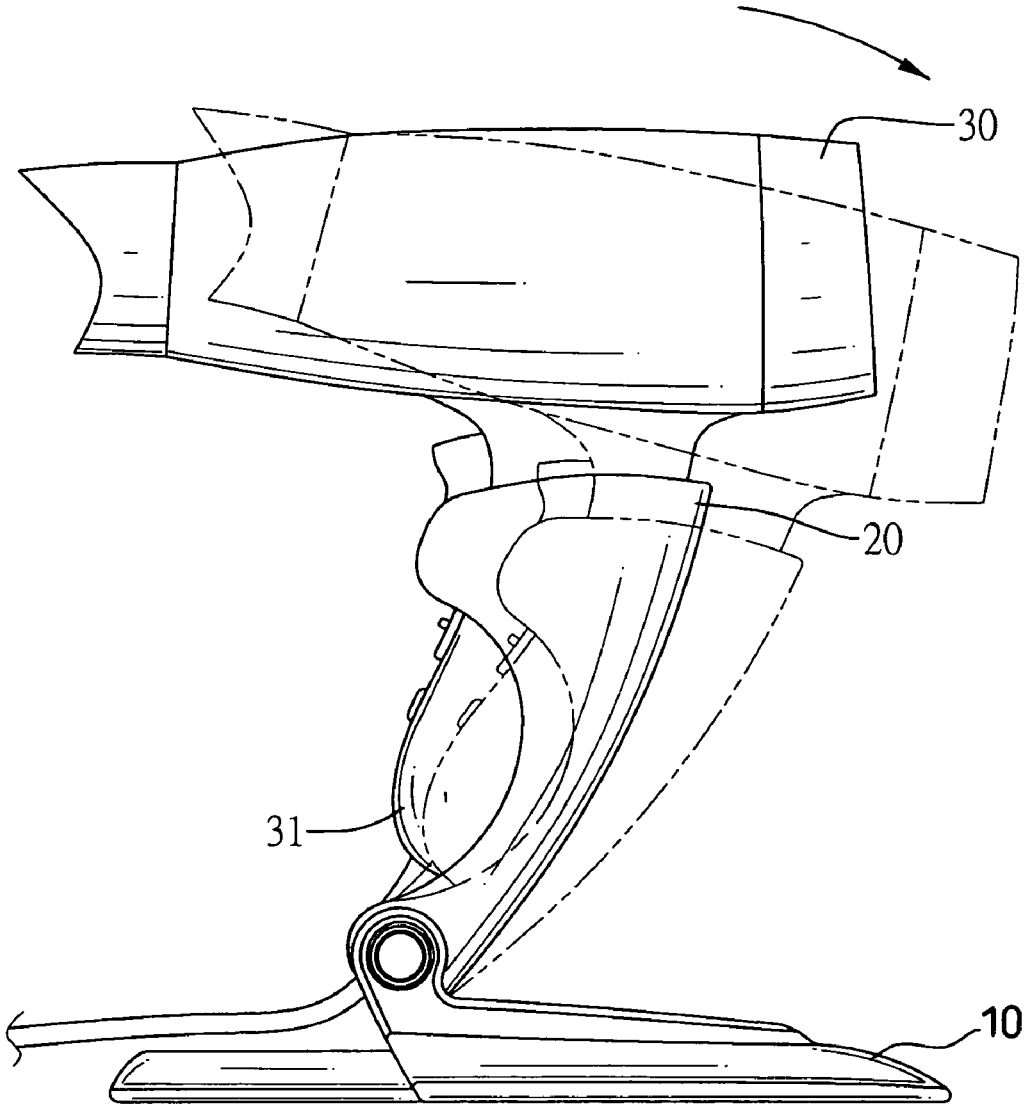
FIG. 5 is an operational side plan view of the hair dryer stand and hair dryer in FIG. 4 adjusted relative to the base.

With reference to FIG. 5, a handheld hair dryer (30) has a handle (31) that is firmly mounted and clamped in the space (23) in the holder (20) between the two curved sides (21, 22). The holder (20) is adjusted to an angle relative to the base (10) to accommodate a specific user. With the arrangement of the lock washers, the lock washers can provide a holding stress to the holder (20). Accordingly, the holder (20) can be held at any desired position with the holding stress provided by the lock washers.

Figure 6:
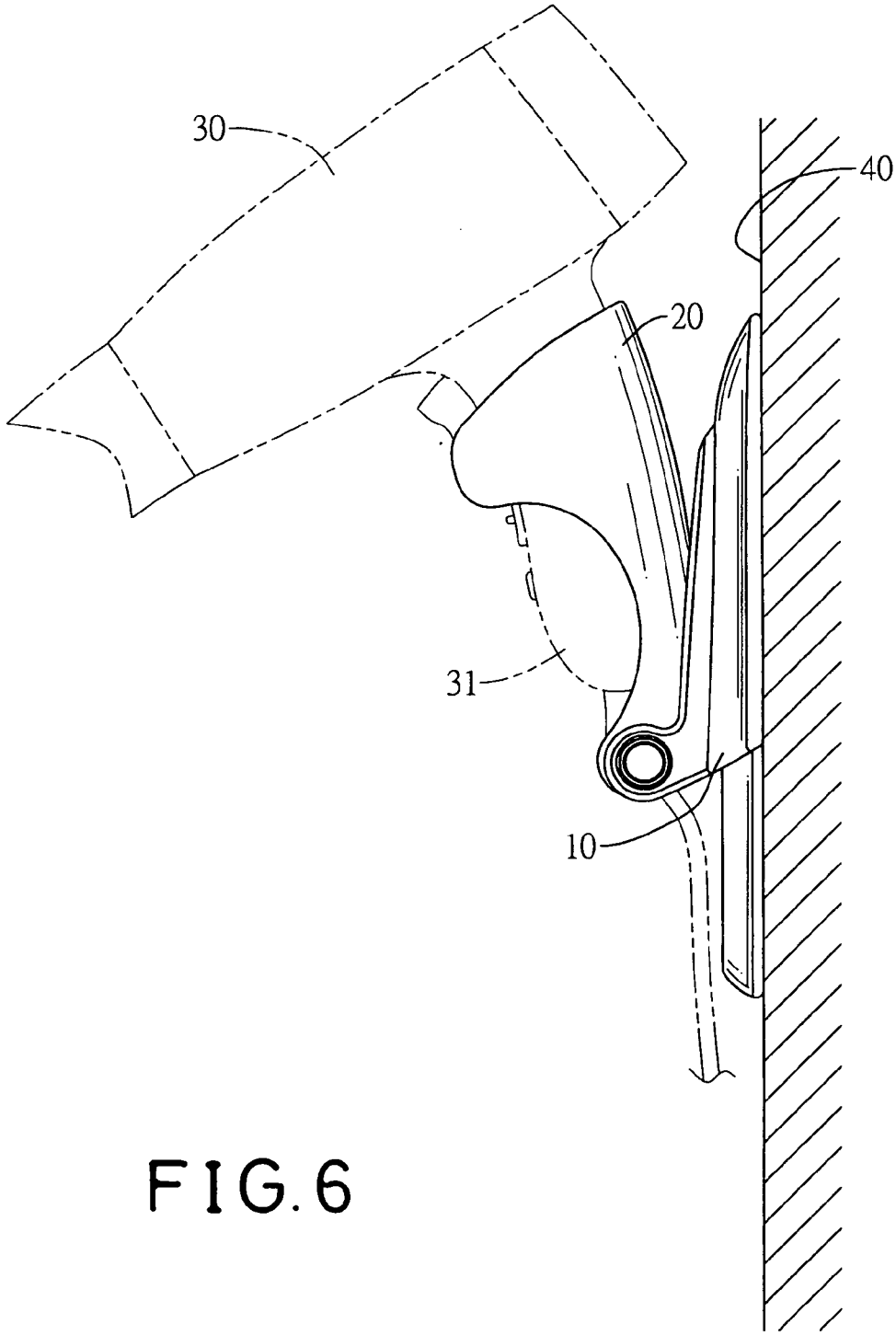
FIG. 6 is another operational side plan view of the hair dryer stand and hair dryer in FIG. 4 securely attached to a vertical surface.

With reference to FIG. 6, the wall bracket (14) can be attached to a wall (40) with screws (not shown), nails (not shown), double sided tape (not shown) or the like. The mounting recess (13) is mounted on the wall bracket (14) to hang the hair dryer (30) on the wall (40). The angle of the hair dryer (30) can be adjusted to dry a person's hair.

Even though numerous characteristics and advantages of the present invention have been set forth in the foregoing description, together with detail of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed is to be understood.

What is claimed is:

1. A hair dryer stand for a handheld hair dryer, the hair dryer stand comprising:

a base having
- two sides;
- a top face;
- a bottom face; and
- first and second ears formed on and extending out from the top face of the base respectively near the two sides, aligned with each other and respectively having
  - inside surfaces;
  - outside surfaces;
  - recessed areas defined respectively in the outside surfaces, aligned with each other and respectively having centers and bottoms;
  - pivot holes defined respectively through the centers of the recessed areas; and
  - two fastener assemblies respectively comprising
    - two washers;
    - two lock washers; and
    - two fasteners;

wherein the washers and lock washers are sequentially mounted respectively in the recessed areas with the lock washers respectively abutting the bottoms of the recessed areas;

a holder mounted pivotally on the top face of the base between the first and second ears and having
- two curved sides formed with each other, and respectively having
  - a mediate section;
  - a proximal end;
  - a distal end;
  - an outside surface;
  - an inside surface; and
  - a pivot pin formed on the outside surface of each curved side near the proximal end and having an axially threaded hole defined longitudinally through the pivot pin, wherein the pivot pins are aligned with each other; and
- a space defined between the curved sides;wherein the fastener assemblies pivotally connect the holder to the first and second ears, and the fasteners pass through the washers, lock washers and pivot holes and screwing respectively into the threaded holes in the pivot pins.

2. The hair dryer stand as claimed in claim 1, wherein the base has a mounting recess defined in the bottom face of the base and having
- a top end;
- a bottom end;
- two sides; and
- two lips formed respectively on opposite sides of the mounting recess at the top end;

a wall bracket having
- a top end;
- two sides;
- a front surface;
- a rear surface; and
- two tongues parallel to the front surface and protruding toward the sides and selectively engaging the two lips in the mounting recess.

3. The hair dryer stand as claimed in claim 2, wherein the first and second ears have respectively a cap mounted respectively in and covering the recessed areas.

4. The hair dryer stand as claimed in claim 1, wherein the fasteners are bolts.

5. The hair dryer stand as claimed in claim 2, wherein the fasteners are bolts.

6. The hair dryer stand as claimed in claim 3, wherein the fasteners are bolts.

7. The hair dryer stand as claimed in claim 1, wherein the fasteners are screws.

8. The hair dryer stand as claimed in claim 2, wherein the fasteners are screws.

9. The hair dryer stand as claimed in claim 3, wherein the fasteners are screws.

10. The hair dryer stand as claimed in claim 1, wherein each curved side has a cutout formed at the mediate section.

11. The hair dryer stand as claimed in claim 2, wherein each curved side has a cutout formed at the mediate section.

12. The hair dryer stand as claimed in claim 3, wherein each curved side has a cutout formed at the mediate section.

* * * * *